US008066309B2

(12) United States Patent
Bartos

(10) Patent No.: US 8,066,309 B2
(45) Date of Patent: Nov. 29, 2011

(54) LATCH

(75) Inventor: Ian Bartos, Vermont South (AU)

(73) Assignee: Gainsborough Hardware Industries, Limited (AU)

( * ) Notice: Subject to any disclaimer, the term of this patent is extended or adjusted under 35 U.S.C. 154(b) by 0 days.

(21) Appl. No.: 10/895,790

(22) Filed: Jul. 21, 2004

(65) Prior Publication Data

US 2005/0057051 A1 Mar. 17, 2005

(30) Foreign Application Priority Data

Jul. 25, 2003 (AU) ..... 2003903863

(51) Int. Cl.
*E05B 9/00* (2006.01)

(52) U.S. Cl. ..... 292/337; 292/1.5; 292/169

(58) Field of Classification Search ..... 292/337, 292/169, DIG. 61, 165, 1.5, 244, 163, 169.13–169.19, 292/DIG. 60; 70/107
See application file for complete search history.

(56) References Cited

U.S. PATENT DOCUMENTS 3,159,994 A * 12/1964 Schulz ..... 70/484
3,544,147 A * 12/1970 James ..... 292/169
3,806,177 A * 4/1974 Rivadossi ..... 292/169.23
3,909,052 A * 9/1975 James ..... 292/169
5,020,836 A 6/1991 Su
5,074,605 A * 12/1991 Fann et al. ..... 292/337
5,205,596 A * 4/1993 Ralph ..... 292/336.3
5,342,101 A * 8/1994 Shih ..... 292/165
5,551,736 A * 9/1996 Fann et al. ..... 292/1.5
5,620,211 A * 4/1997 Ellis ..... 292/1.5
5,647,617 A * 7/1997 Kajuch ..... 292/1.5
5,690,372 A * 11/1997 Jans ..... 292/169
6,662,603 B2 * 12/2003 Morris ..... 70/107

FOREIGN PATENT DOCUMENTS

GB 2053338 2/1981

OTHER PUBLICATIONS

Definition of cam and gear; http://www.m-w.com/; Aug. 29, 2007.*

* cited by examiner

*Primary Examiner* — Kristina Fulton
(74) *Attorney, Agent, or Firm* — Brinks Hofer Gilson & Lione

(57) ABSTRACT

A latch (10) including a casing (12) adapted to be fixedly mounted in a door, a carriage (20) mounted in the casing (12) and adapted for slidable movement relative to the casing (12) between an actuated position and a return position, a first spring (34) biasing the carriage (20) to the return position and a lock bolt (42) mounted to the carriage (20) and adapted to protrude from the casing (12) when the carriage (20) is in the return position. The latch (10) also includes a master cam (60) and a slave cam (80) each pivotally mounted to the casing (12) such that the master cam (60) directly acts upon the slave cam (80) whereby the pivoting actuation of the master cam (60) drives pivoting actuation of the slave cam (80) which in turn actuates sliding movement of the carriage (20) from the return position to the actuated position. Pivoting actuation of the master cam (60) through at most 35° is sufficient to move the carriage (20) to the actuated position.

33 Claims, 18 Drawing Sheets

LATCH

CROSS REFERENCE TO RELATED APPLICATIONS

This application claims priority to Australian provisional application no. 2003903863, filed Jul. 25, 2003.

FIELD OF THE INVENTION

The present invention relates to a latch for doors.

BACKGROUND OF THE INVENTION

The use of latches to retain doors closed but not locked is widespread, particularly for internal doors of residences or offices where locking security is not required. Latches have a lock bolt that is spring-biased to a latching position, in which the lock bolt protrudes from an edge face of the door. Turning a knob or lever associated with the latch retracts the lock bolt to its unlatching position in which the lock bolt is retracted into the door, to allow the door to be opened. The knob or lever is also spring-biased to a position corresponding to the latching position of the lock bolt. This is typically horizontal for a lever handle.

When the door is closed without turning a knob or lever, the lock bolt initially engages a strike plate attached to a door jamb which urges the lock bolt to retract into the door, into the unlatching position. The lock bolt then travels across the strike plate and enters a recess in the strike plate. This allows the lock bolt to return to its (protruding) latching position to retain the door closed.

A known simple latch uses a single spring to bias the latch mechanism and the knob or lever to the latching position. A spring of sufficiently high stiffness to return the knob or lever to the latching position often makes it difficult to close the door without also turning the knob or lever, which is inconvenient. A spring of sufficiently low stiffness to allow easy door closure without turning of the knob or lever often does not return the latch mechanism and the knob or lever to the latching position (which can result in lever sag) and so won't reliably latch the door.

Another known latch uses a single spring for biasing the lock bolt and a separate return mechanism in the door furniture to return the knob or lever to the latching position. This complicates the production and assembly of the latch.

Another known latch utilises a relatively stronger spring to return the knob or lever to prevent sag and a relatively weaker spring to bias the lock bolt to provide easy door closure. A disadvantage of known latches of this type is that they require the knob or lever to be rotated through at least 75° to sufficiently retract the bolt for door opening.

Other known latches require that components of the latch mechanism protrude significantly outside of the latch casing. A disadvantage of known latches of this type is that they requires a large cross bore hole in the door to accommodate the protruding components and equally large door furniture to conceal the bore hole.

It is the object of the present invention to substantially overcome or at least ameliorate one or more of the above prior art disadvantages.

SUMMARY OF THE INVENTION

Accordingly, the present invention provides a latch including:

a casing adapted to be fixedly mounted in a door;

a carriage mounted in the casing and adapted for slidable movement relative to the casing between an actuated position and a return position;

a first spring biasing the carriage to the return position;

a lock bolt mounted to the carriage and adapted to protrude from the casing when the carriage is in the return position;

a master cam and a slave cam each pivotally mounted to the casing such that the master cam directly acts upon the slave cam whereby pivoting actuation of the master cam drives pivoting actuation of the slave cam which in turn actuates sliding movement of the carriage from the return position to the actuated position;

wherein pivoting actuation of the master cam through at most 35° is sufficient to move the carriage to the actuated position.

Preferably, the master cam and slave cam are shaped so as not to protrude significantly from the casing during operation. The shape of the cams is preferably such that in the actuated position, the extremities of each cam are substantially flush with the casing exterior.

The stroke of the carriage is defined as the distance moved by the carriage between the actuated and return positions and is preferably between 8.5 and 9.5 mm, more preferably about 9 mm.

In a preferred form, the casing is elongate and has a first end and a second end. A face plate is mounted at, and the lock bolt protrudes from, the first end. The master cam is desirably mounted in the casing adjacent the second end. The slave cam is desirably mounted longitudinally adjacent the master cam.

The backset of the latch is defined as the distance from the face plate to the axis of pivoting of the master cam and is preferably 60 mm. Alternatively, the backset is greater than 60 mm, for example specific embodiments have backsets of 70 mm, 95 mm and 127 mm.

In a preferred form, the casing is provided with at least one, and preferably two, transverse apertures through which door furniture fastening screws can pass.

Preferably, the carriage is a substantially U-shaped member having two spaced apart side walls extending from an open end and joined by a closed end. The open end is preferably arranged about the slave cam with the closed end extending towards the casing first end. The U-shaped member walls preferably include elongated apertures having engagement surfaces for engagement by the slave cam for sliding the carriage upon operation of the slave cam. A stop is preferably disposed between the walls of the U-shaped member and fixed relative to the casing, the first spring being disposed between the U-shaped member closed end and the stop in order to bias the carriage to slide in the first direction.

In a preferred form, the master cam comprises a generally cylindrical cam body having a main lobe and a diametrically opposed tail lobe, each extending radially of the cam body, the main and tail lobes being adapted to contact the casing of the latch and to thereby limit the extent of pivoting of the master cam. Preferably, pivoting of the master cam is limited to a maximum of 30° to 35°, and more preferably about 32°. Desirably, the master cam further includes a pair of cam arms for engaging the slave cam. Preferably, the cam arms extend tangentially of the cam body and laterally of the main lobe. A knob or lever is preferably mounted to the door for pivotal actuation of the master cam and has corresponding actuated and return positions.

Preferably, both cams are mounted to the casing for pivoting about axes that are substantially perpendicular to the sliding movement of the carriage. Further preferably, the master cam is also slidably mounted to the casing to allow the master cam axis to be selectively offset from the perpendicular and selectively moved longitudinally of the latch. The master cam preferably includes opposed cylindrical bosses which are slidably received in respective opposed obround recesses in the casing.

Preferably, the latch casing further includes a spacer arranged at its second end and adapted for contacting the master cam tail lobe to limit the pivotal rotation of the master cam.

In a preferred form, the slave cam comprises a generally cylindrical cam body having a main lobe and a diametrically opposed tail lobe, the slave cam tail lobe being adapted to be engaged by the cam arms of the master cam to drive the pivotal actuation of the slave cam. Preferably, the main lobe of the slave cam extends radially and tangentially of the slave cam body and has tangentially opposed shoulders adapted to be received by the apertures of the carriage side walls, to engage the engagement surfaces of the carriage, and to thereby drive the sliding movement of the carriage when the slave cam is pivotally actuated.

Preferably, the action of the cams on each other and on the carriage is such that the angles of contact between the cams, and between the lobe shoulders and carriage, follow a rolling action.

The latch is preferably provided with a lock bolt assembly in which the lock bolt is adapted for slidable movement relative to the carriage between a rest position and an engaged position and in which a second spring is provided to bias the lock bolt towards the rest position.

The first spring preferably has a greater spring constant than the second spring. Preferably, the first spring has a spring constant sufficient to return the door furniture knob to the return position.

The lock bolt assembly preferably further includes a stem. The stem extends from the lock bolt and is slidably received in an aperture provided in the closed end of the carriage. The second spring is desirably disposed between the carriage and the lock bolt, in order to bias the lock bolt towards the rest position.

The master cam is preferably larger in diameter than the slave cam and is further preferably as large in diameter as the latch casing will practically accommodate.

Preferably, the latch is operable by pivoting actuation of the master cam in either direction.

BRIEF DESCRIPTION OF THE DRAWINGS

Preferred forms of the present invention will now be described by way of example only, with reference to the accompanying drawings, wherein.

DETAILED DESCRIPTION OF THE PREFERRED EMBODIMENTS

Figure 1A:
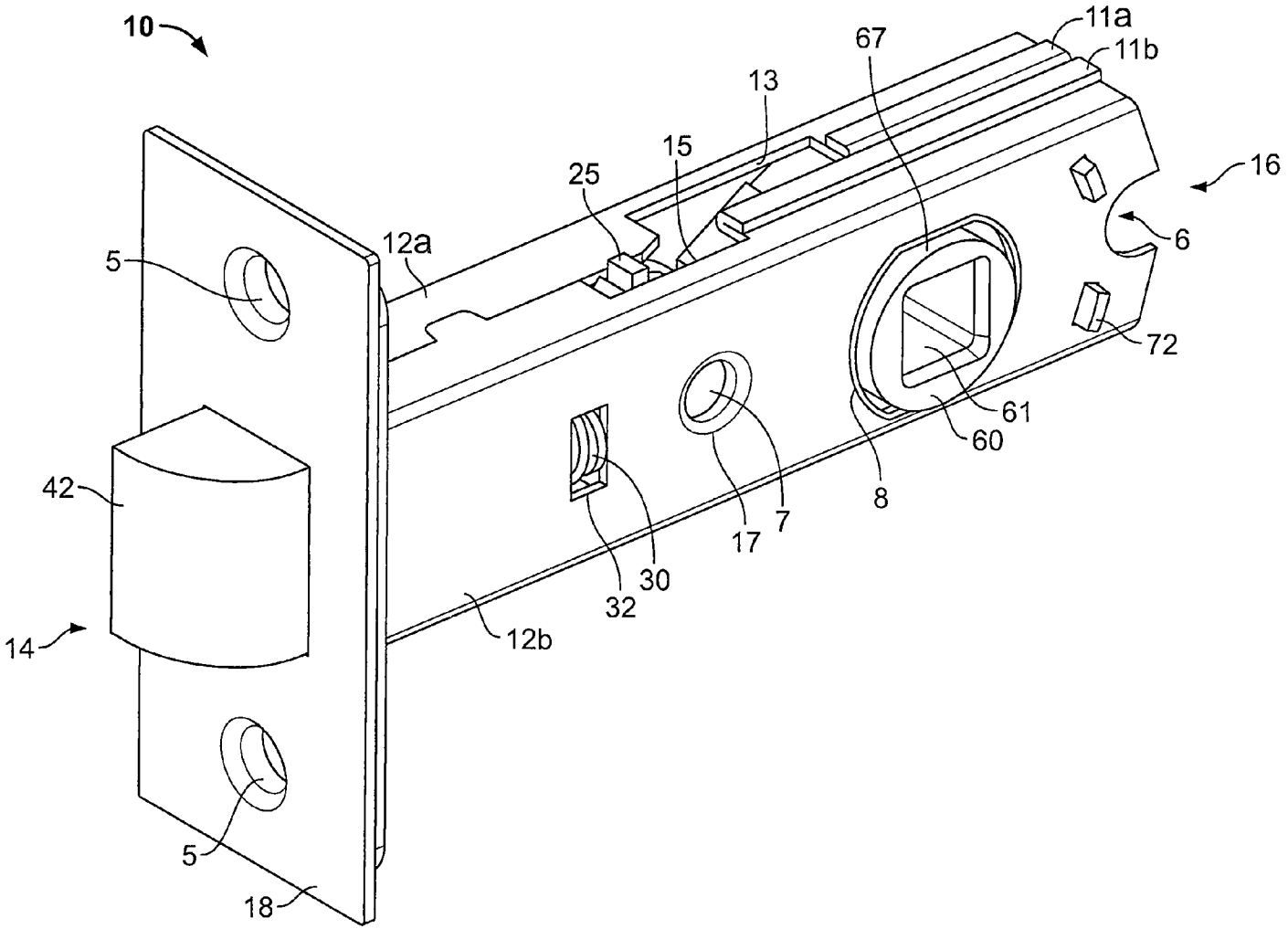
FIGS. 1A, 1B and 1C respectively show assembled perspective, partly assembled lateral and partly assembled perspective views of a latch according to a first preferred embodiment of the present invention in a latching configuration with the cams in a return position and the lock bolt extended in a return position.

FIGS. 1A to 3C show a first preferred embodiment of a latch 10 according to the present invention which is adapted to be mounted in a door (not shown) for operation with door furniture (not shown) such as a door knob. The latch 10 includes an elongated outer casing 12, formed from casing halves 12*a* and 12*b*, having a first end 14 and a second end 16. A face plate 18 and back plate 19 are mounted at the first end 14 to enable the latch 10 to be fixedly mounted in the door by screws (not shown) that pass through holes 5. The casing 12 also includes transverse holes 7, provided by extrusions 17, and recesses 6 in the second end 16 through which door furniture fastening screws (not shown) can pass. This allows the door furniture to be aligned accurately with respect to the latch 10. Elongate apertures 13 and 15 are provided in the top and bottom surfaces of casing halves 12*a* and 12*b*, respectively, to accommodate moving components of the latch 10. A spacer 70 is mounted at the second end 16 by swaged tabs 72 and clamps the casing halves 12*a* and 12*b* together. The casing halves 12*a* and 12*b* also include return folds 11*a* and 11*b* which help strengthen the casing 12.

Figure 1B:
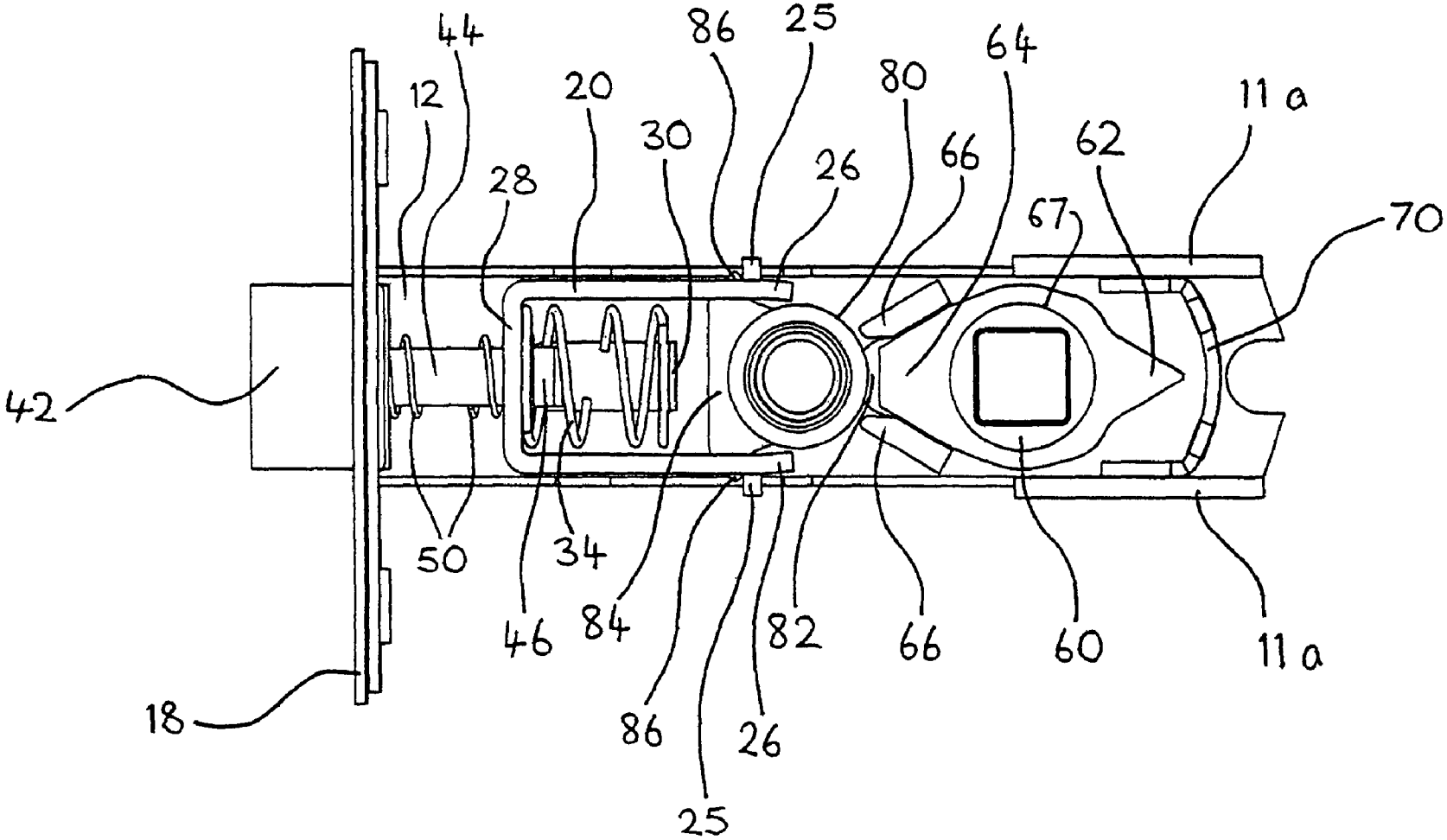
Figure 1C:
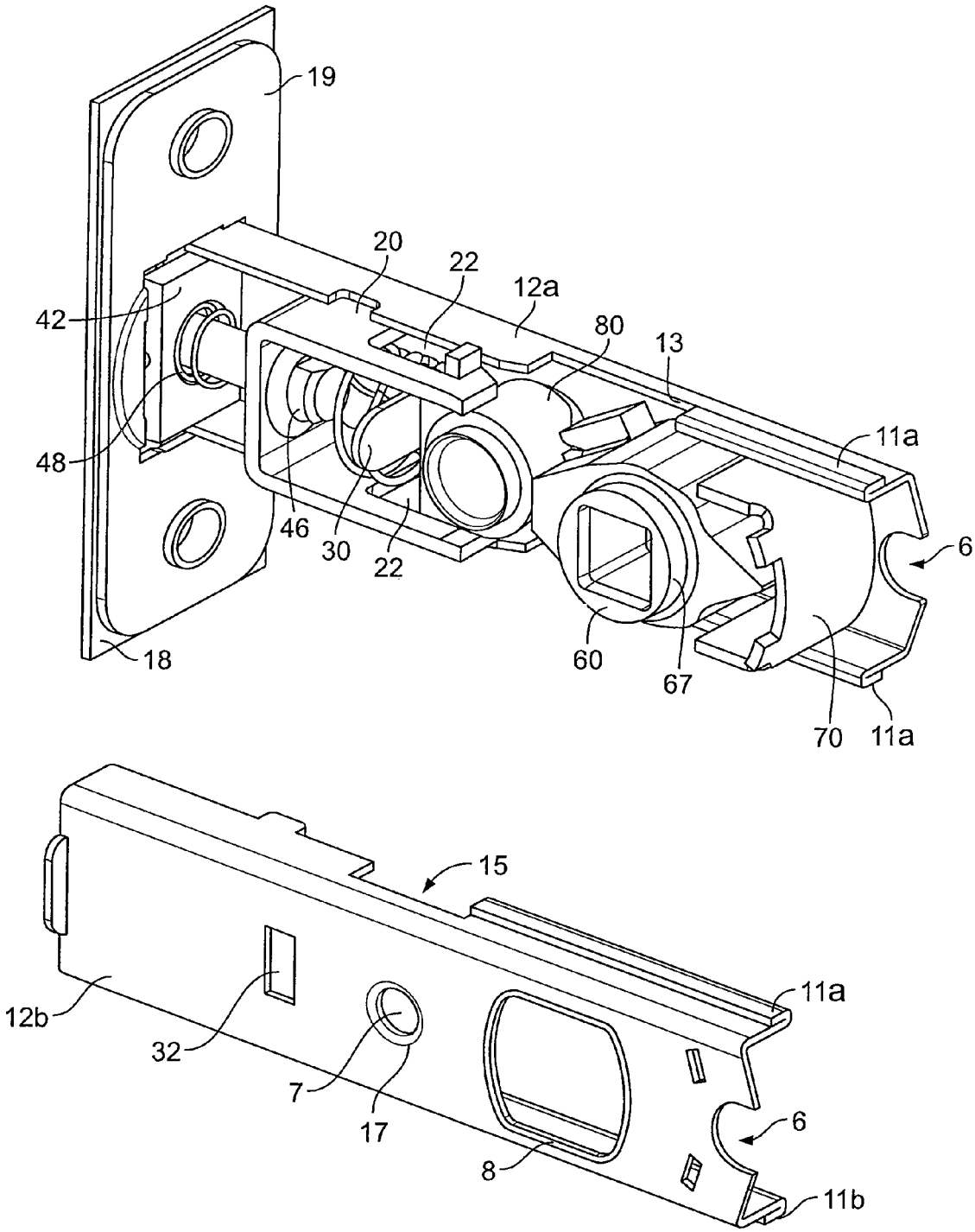
Figure 2A:
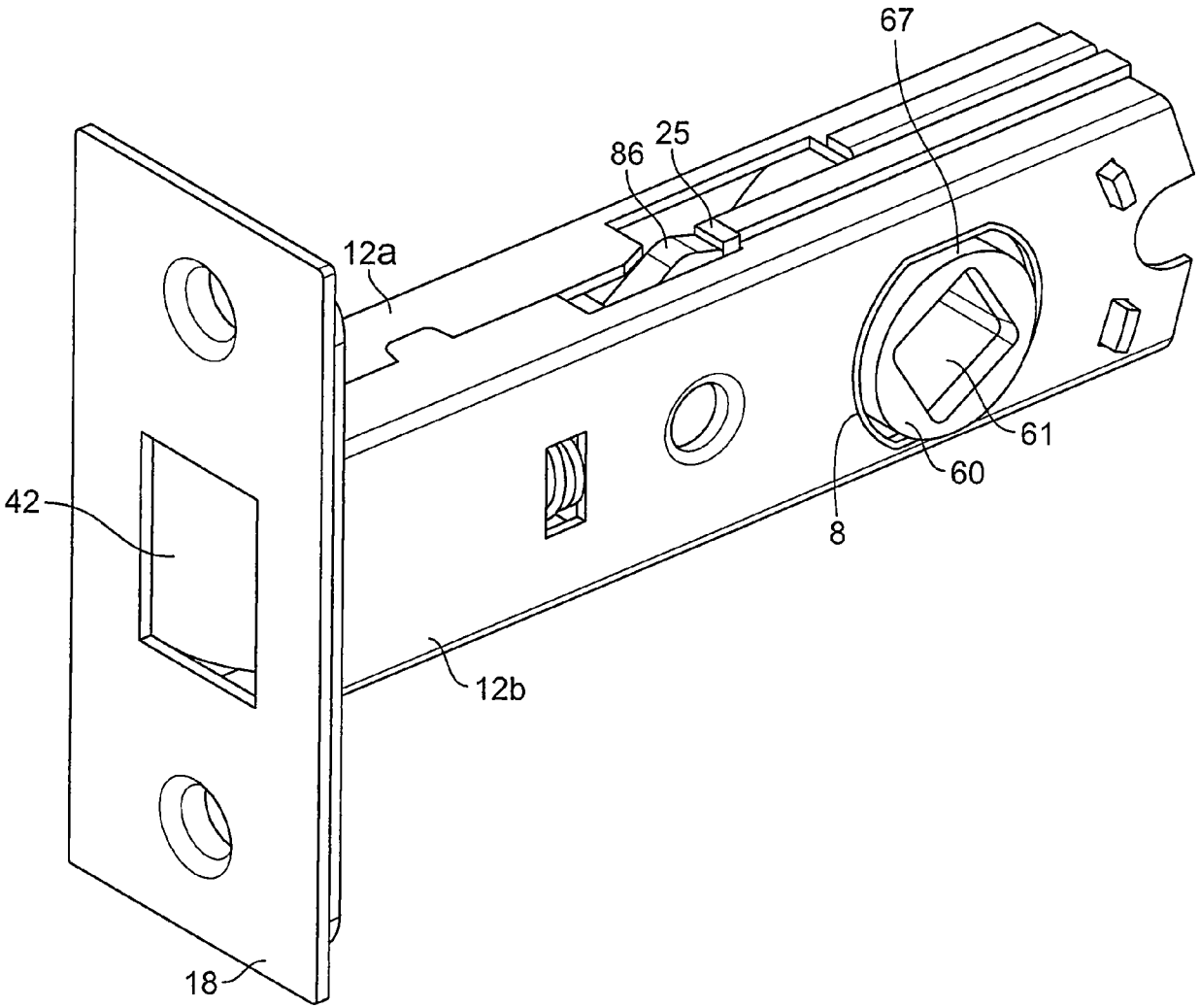
FIGS. 2A, 2B and 2C respectively show assembled perspective, partly assembled lateral and partly assembled perspective views of the latch of FIG. 1 in an active unlatching configuration with the cams in an actuated position and the lock bolt retracted in an actuated position.
Figure 2B:
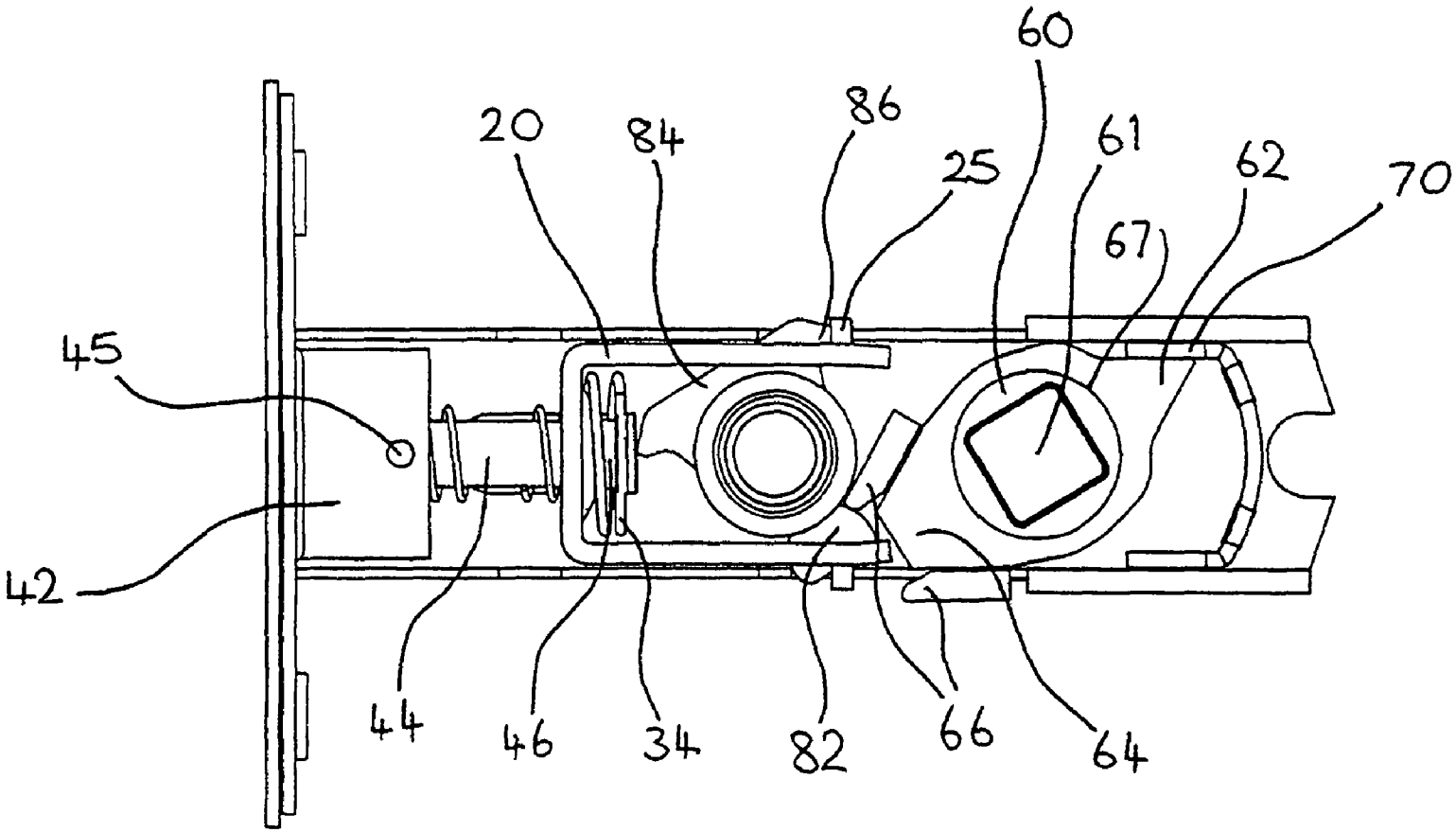
Figure 2C:
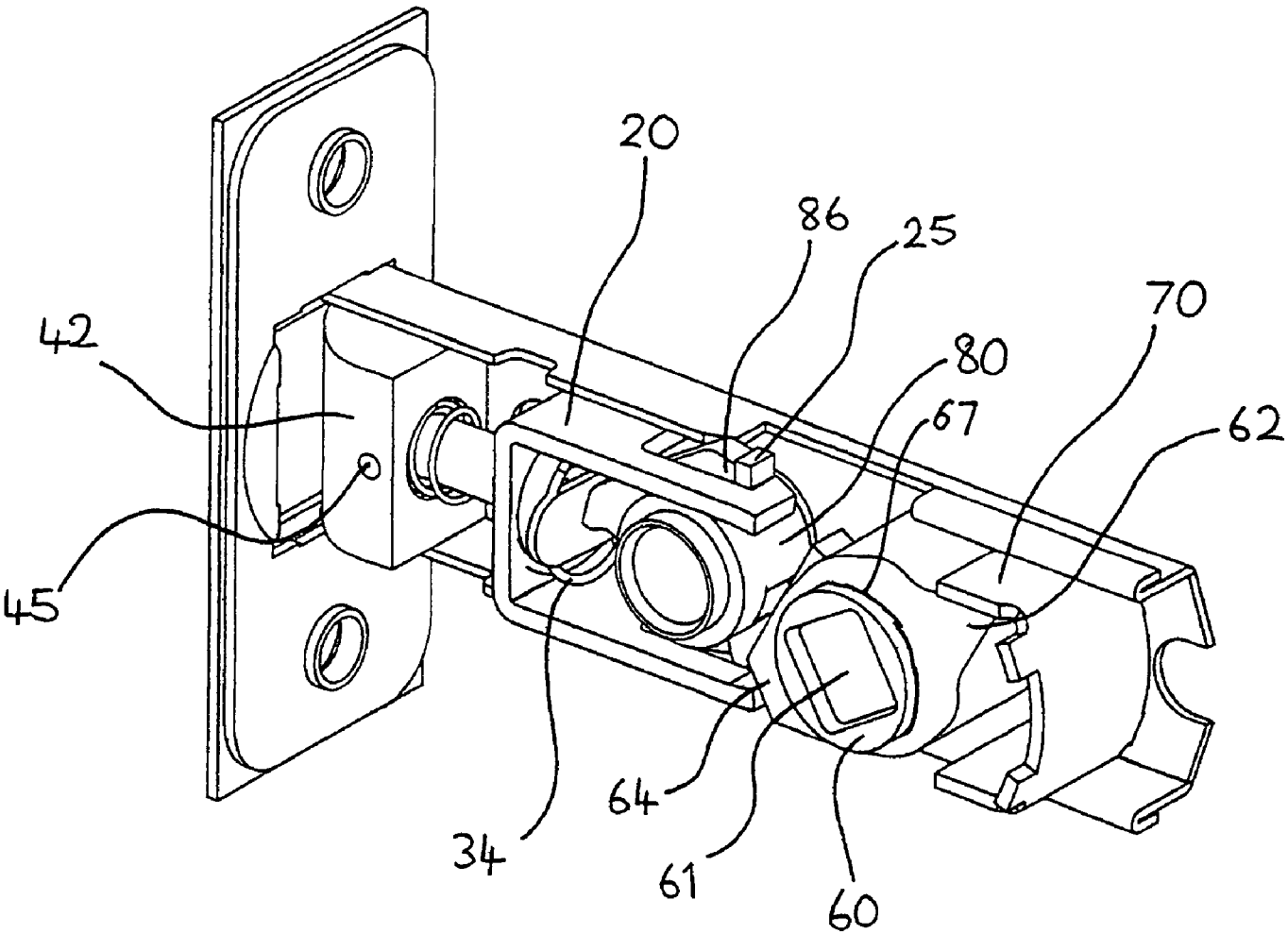

A carriage 20 is slidably mounted in the casing 12 for slidable movement between a return position (FIGS. 1A-1C) and an actuated position (FIGS. 2A-2C). The carriage 20 is U-shaped and has side walls 26 and a closed end 28. The closed end 28 extends towards the casing first end 14. The carriage 20 further includes slots 22 provided in each side wall 26 and outwardly extending engagement surfaces 25, extending from the end of each slot 22 furthest from the closed end 28. The stroke of the carriage 20 is defined as the distance moved by the carriage from the return position to the actuated position and in this embodiment is nominally 9.0 mm. Manufacturing tolerances result in a possible range of 8.5 to 9.5 mm with a minimum specification of 8.0 mm.

A stop 30 is disposed between the walls 26 of the carriage 20 and is formed by bending a cut strip from one half of the latch casing 12*a* and securing the free end of the strip in stop mounting slot 32 formed in the other half of the latch casing 12*b*. A first spring 34 is disposed between the carriage closed end 28 and the stop 30 in order to bias the carriage 20 to slide to the return position.

A lock bolt assembly is mounted to the carriage 20 and is biased to a rest position relative to the carriage 20 by a second spring 50. The second spring 50 has a lesser spring constant than the first spring 34. The lock bolt assembly includes a lock bolt 42 mounted on a stem 44 via a roll pin 45. The stem 44 extends to, and is slidably received by, an aperture formed in the carriage closed end 28. The stem 44 has a flanged end 46 for engaging with the carriage closed end 28. The second spring 50 is disposed about the stem 44 between the carriage closed end 28 and the lock bolt 42, and engages a recess 48 formed in the lock bolt 42.

A master cam 60 is pivotally mounted in the casing 12 via cam mounting holes 8 adjacent the casing second end 16. The cam 60 has opposed cylindrical outer bosses 67. Cam mounting holes 8 are elongated, by being obround, and allow longitudinal movement of the cam bosses 67, and thus the cam 60, relative to the casing 12 to allow for variance in installation. The elongate holes 8 also allow the master cam axis to be selectively oriented substantially perpendicular to the longitudinal extension of the casing 12, or offset thereto, allowing for further variance in installation. The master cam 60 comprises a generally cylindrical cam body having a square axial drive hole 61 into which a drive spindle (not shown) is fitted. The body of the master cam 60 is as large in diameter and axial dimension as the casing 12 will accommodate in order to maximise its strength. This is made possible by limiting the length and operational movement of the carriage 20 such that the carriage side walls 26 do not extend to the master cam 60, such that the entire height of the casing 12 is available to house the master cam 60. The master cam 60 further comprises a radially extending main lobe 64 and a diametrically opposed tail lobe 62. The main lobe 64 and tail lobe 62 are dimensioned such that they contact the latch casing 12 and spacer 70, respectively, when the master cam 60 is pivotally actuated in either direction through a nominal 32° from the return position. Manufacturing tolerances result in a possible range of 30° to 35°. The distribution of torque from the master cam 60 to the latch casing 12 via the main lobe 64 and tail lobe 62 reduces fatigue on the master cam 60 and the latch casing 12. The master cam 60 further includes cam arms 66 that extend tangentially of the cam body and laterally of the main lobe 64. The backset of the latch is defined as the distance from the face plate to the pivoting axis of the master cam and in this embodiment is 60 mm. In other embodiments, the backset may be greater than 60 mm and specific embodiments have backsets of 70 mm, 95 mm and 127 mm.

A slave cam 80 is pivotably mounted on bearing extrusions 17 in the casing 12 longitudinally adjacent the master cam 60 and about an axis substantially perpendicular to the longitudinal extension of the casing 12. The slave cam 80 comprises a generally cylindrical cam body having a radially extending tail lobe 82 and a diametrically opposed radially and tangentially extending main lobe 84. Main lobe 84 includes tangentially opposed shoulders 86 adapted to extend into the carriage side wall slots 22 and to engage engagement surfaces 25 formed therein.

The angles of contact between the cams 60, 80 and between the slave cam 80 and the carriage 20 provide a rolling action between the cam lobes 64, 82 and between the lobe shoulders 86 and engagement surfaces 25. This reduces wear on the cams 60, 80 and carriage 20.

FIGS. 1A-1C show the latch 10 in a latching configuration in which the cams 60 and 80 are in a return position and the lock bolt 42 is extended in a rest position so that the lock bolt 42 protrudes from the first end 14 of the casing 12. When the latch 10 is fixedly mounted in a door (not shown), the lock bolt 42 protrudes from an edge face of the door in the latching configuration.

FIGS. 2A-2C show the latch 10 in an active unlatching configuration in which the cams 60 and 80 are in an actuated position, caused by the turning of the door furniture associated with the master cam 60, and the lock bolt 42 is retracted in a rest position. The cam arms 66 of the cam 60 are dimensioned such that pivoting actuation of the master cam 60 drives counter pivoting actuation of the slave cam 80, via the engagement of cam arms 66 with the slave cam lobe 82. In turn, the slave cam 80 actuates sliding movement of the carriage 20 relative to the casing 12, via the engagement of the slave cam main lobe 84 with the carriage 20, driving the carriage 20 from the return position to the actuated position. In the actuated position, the pivotal actuation of the master cam 60 is limited by the tail lobe 62 contacting the spacer 70 and the main lobe 64 contacting the casing 12 and therefore, the slave cam 80, carriage 20 and first spring 34 are not subject to excessive loads placed on the door furniture. This means that these components 80, 20 and 34 are protected from excessive loads, and so will not suffer damage, and do not have to be made from relatively high strength material, or be relatively large in size, which results in a reliable latch with a long life.

The engagement surfaces 25 of the carriage 20, the cam arms 66 and cam lobe 84 are shaped such that, in the actuated position, the cam arms 66 and cam lobe 84 are substantially flush with the latch casing and do not significantly protrude from the casing 12 during operation. The shape and size of cams 60 and 80 provides a gear ratio therebetween such that pivoting the master cam 60 through an angle of 30° to 35°, moves the carriage 20 sufficiently to achieve the active unlatching configuration which enables the door to be opened. This design allows the latch 10 to be compact yet easy to operate and reduces fatigue of both the door furniture and operator. The elongate apertures 13 and 15 in the casing 12 allow the cam arms 66, cam shoulders 86 and engagement surfaces 25 to protrude slightly from the casing to facilitate the compact design of the latch. The absence of significantly protruding components greatly simplifies installation of the latch and obviates the need for a large cross bore hole in the door to accommodate movement of the latch mechanism outside the latch case. Smaller and perhaps more stylish door furniture is able to be used as there is not such a large bore hole to conceal. In the absence of torque to the cams 60 and 80, the first spring 34 biases the carriage 20 to slide to the return position, which urges the cams 60 and 80 via engagement surfaces 25 and slave cam tail lobe 82 to return to the return position shown in FIGS. 1A-1C and return the latch 10 to the latching configuration.

Figure 3A:
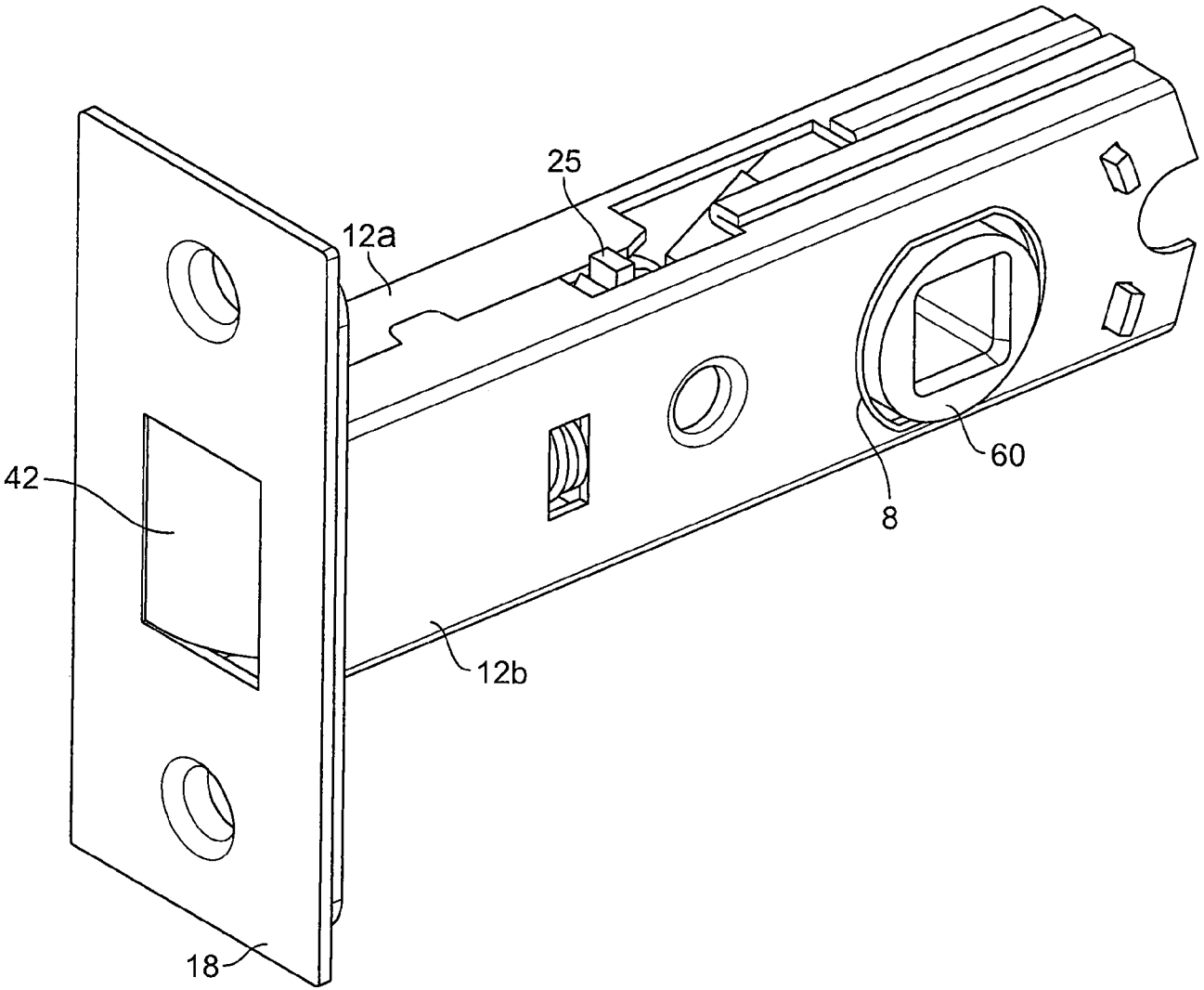
FIGS. 3A, 3B and 3C respectively show assembled perspective, partly assembled lateral and assembled perspective views of the latch of FIG. 1 in an inactive unlatching configuration with the cams in a return position and the lock bolt retracted.
Figure 3B:
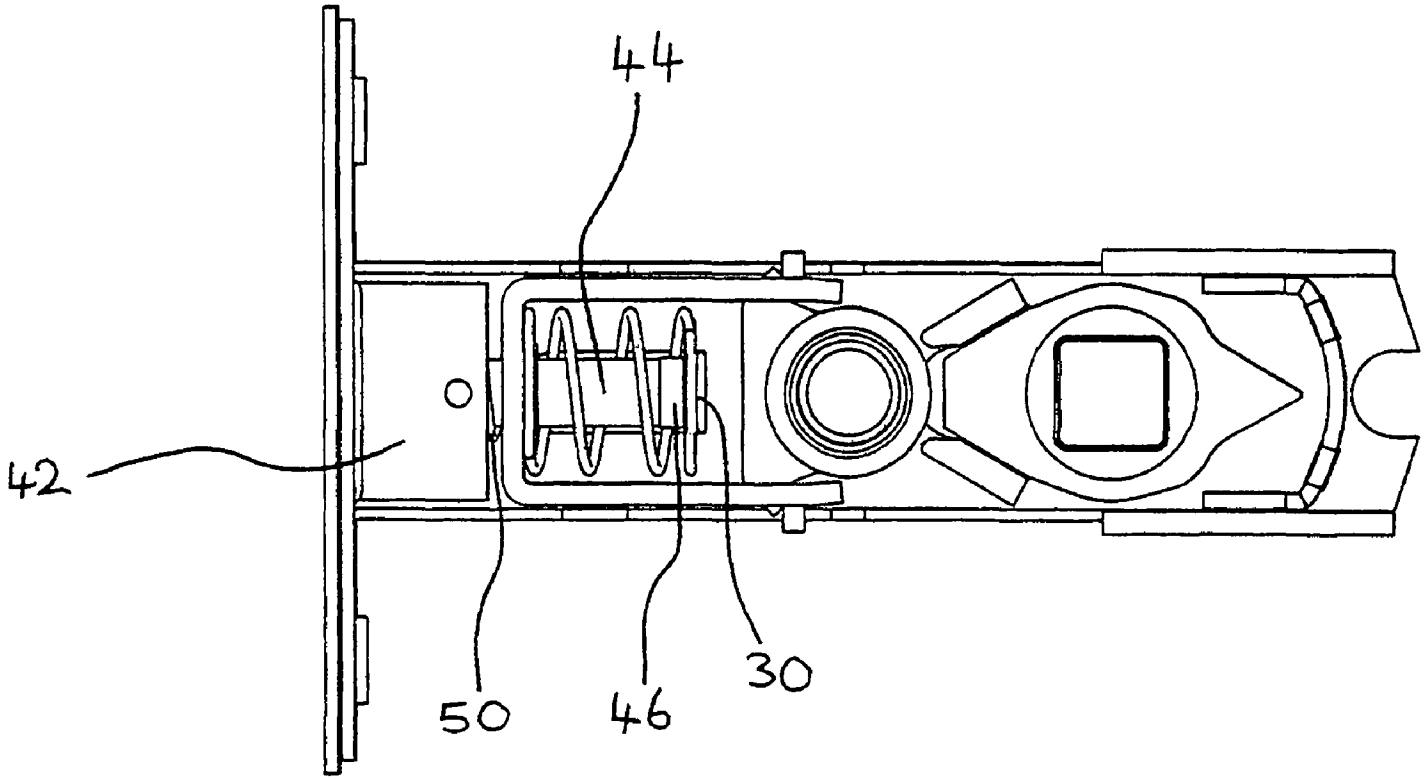
Figure 3C:
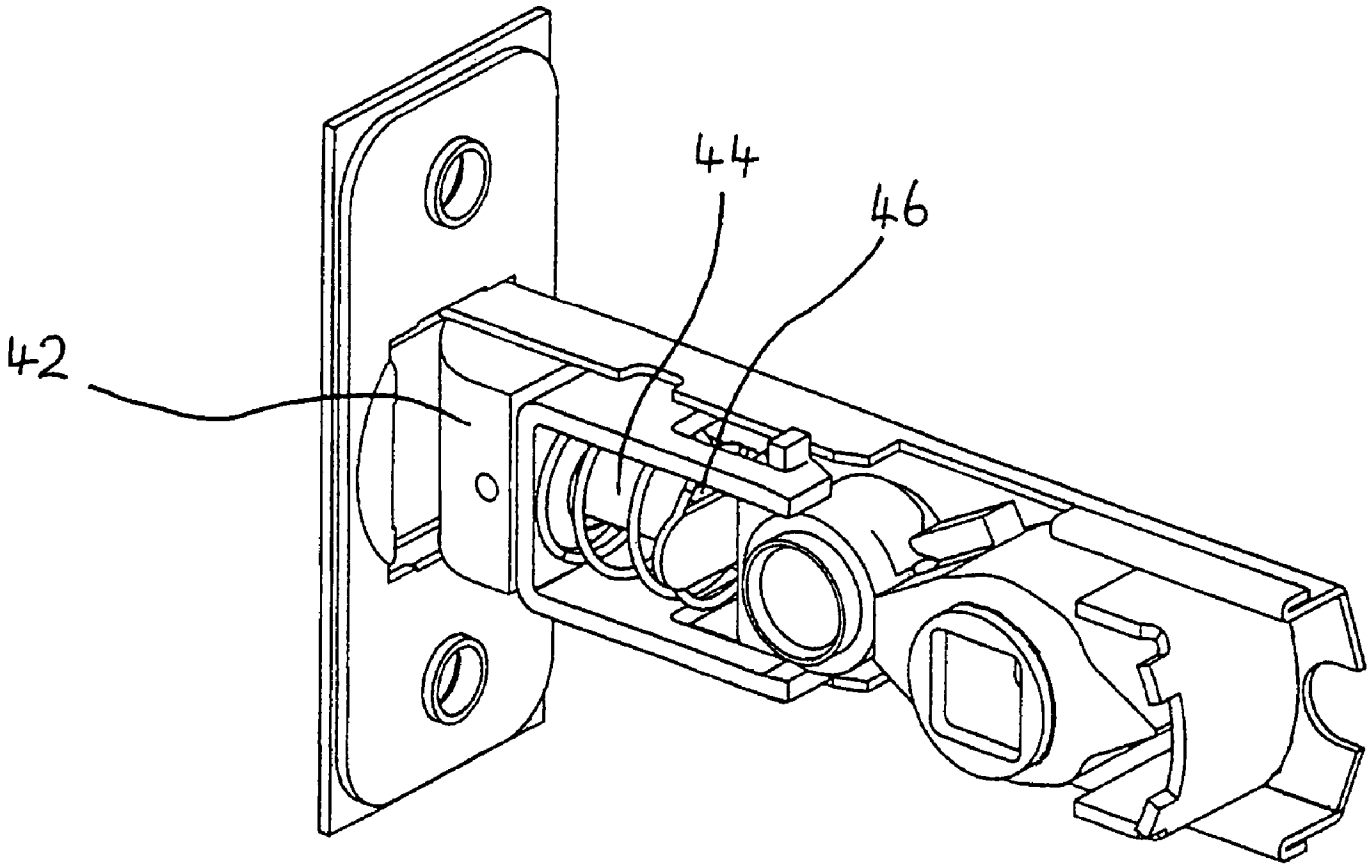
Figure 4A:
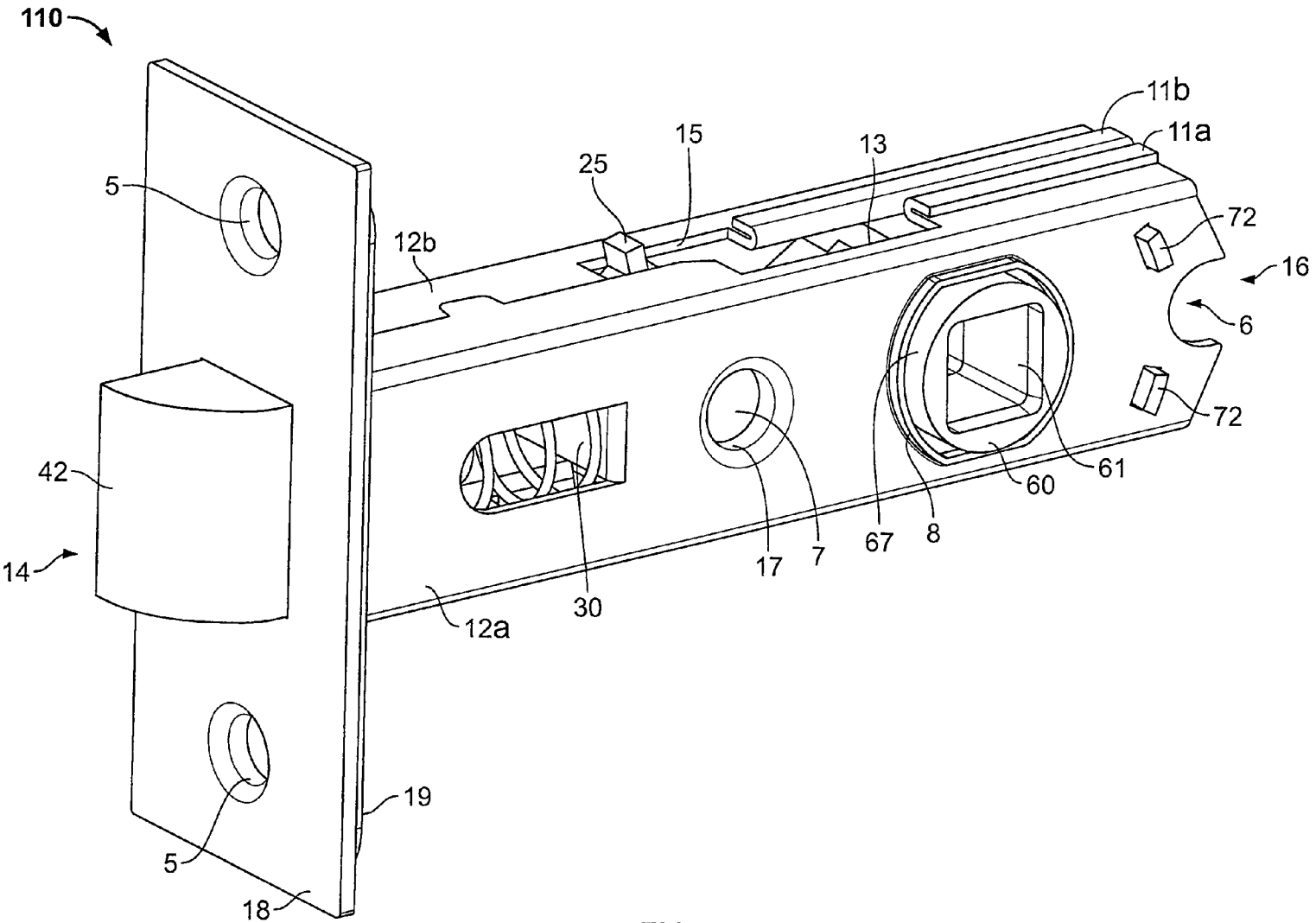
FIGS. 4A, 4B and 4C respectively show assembled perspective, partly assembled lateral and partly assembled perspective views of a latch according to a second preferred embodiment of the present invention in a latching configuration with the cams in a return position and the lock bolt extended in a return position.
Figure 4B:
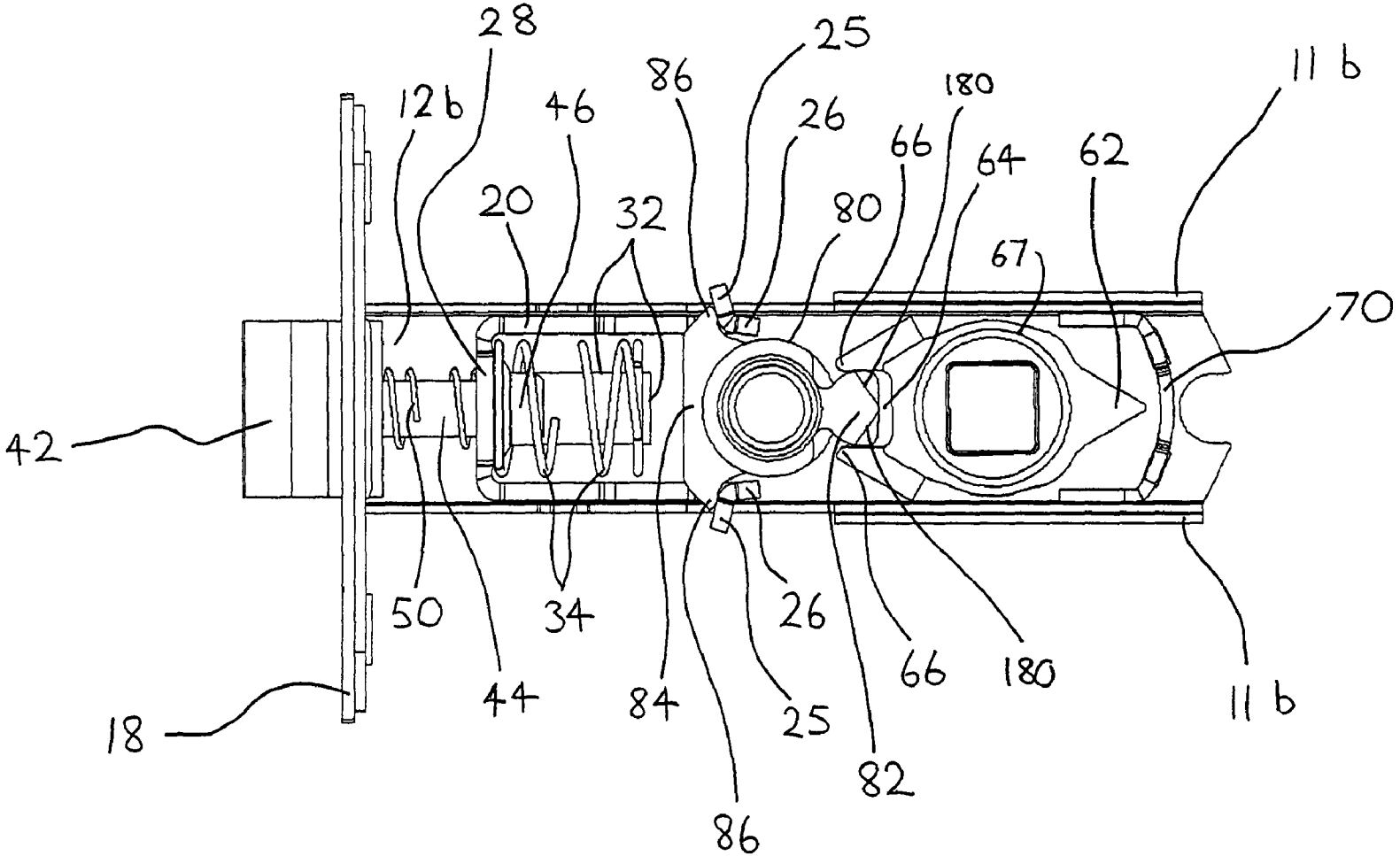
Figure 4C:
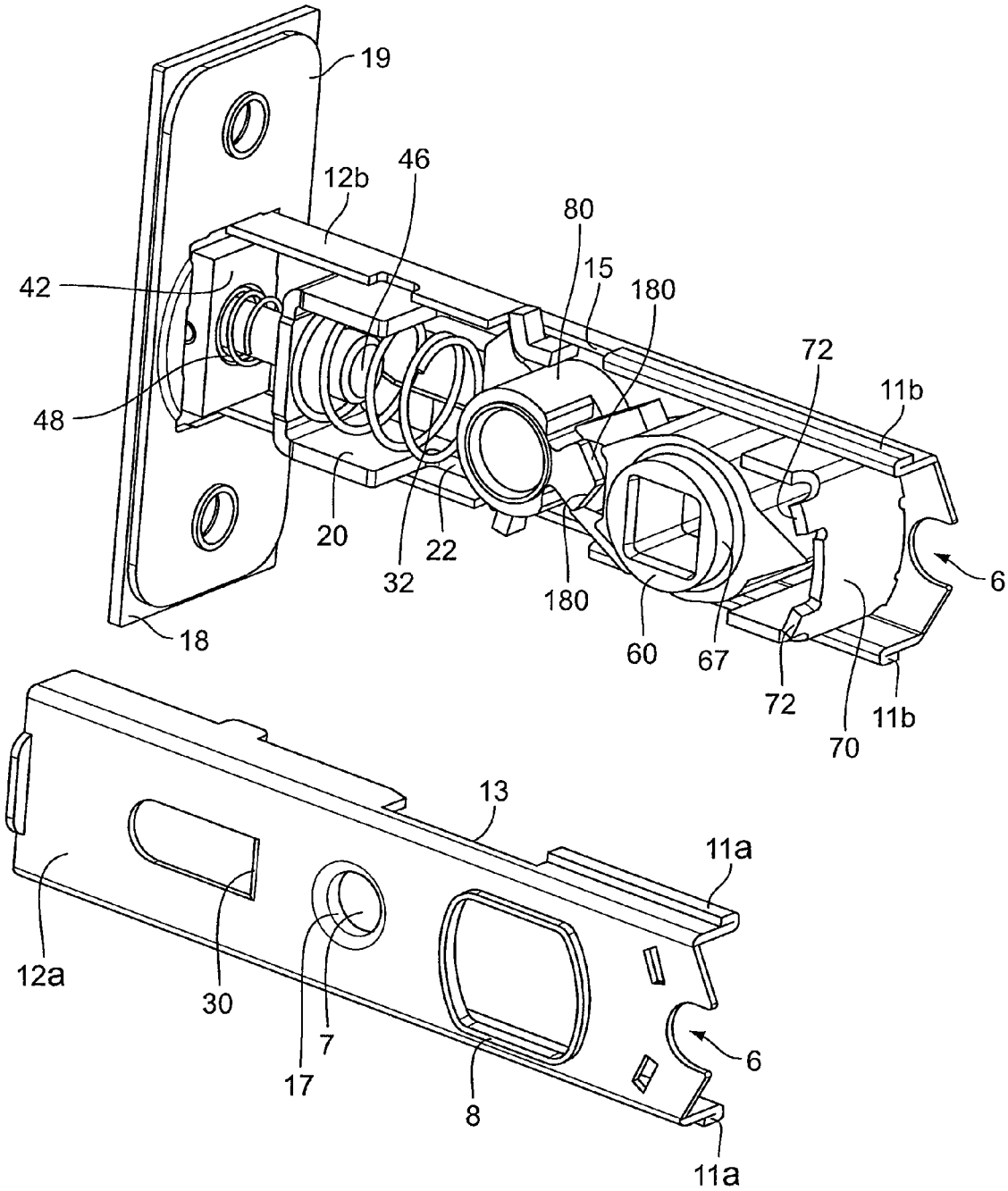
Figure 5A:
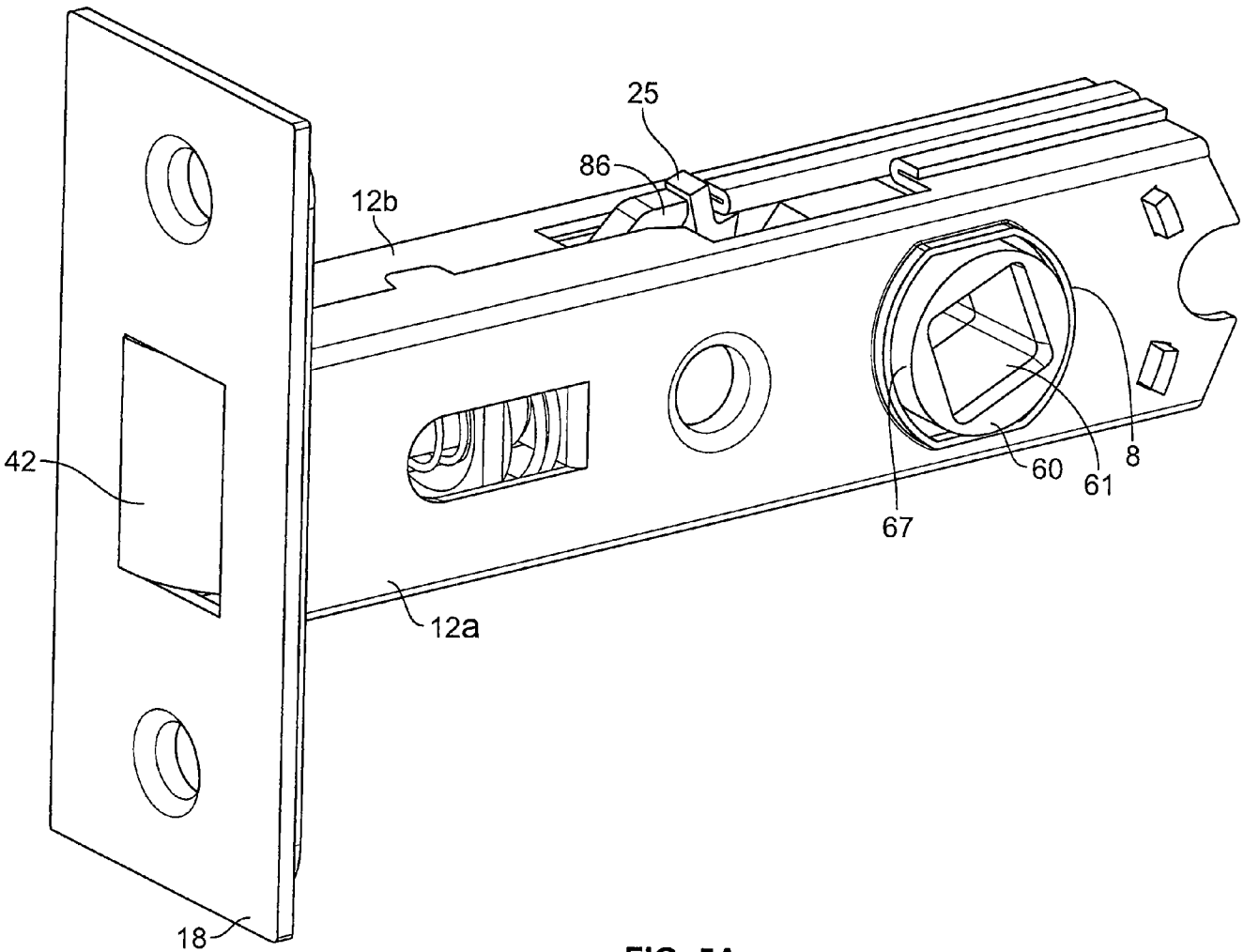
FIGS. 5A, 5B and 5C respectively show assembled perspective, partly assembled lateral and partly assembled perspective views of the latch of FIG. 4 in an active unlatching configuration with the cams in an actuated position and the lock bolt retracted in an actuated position.
Figure 5B:
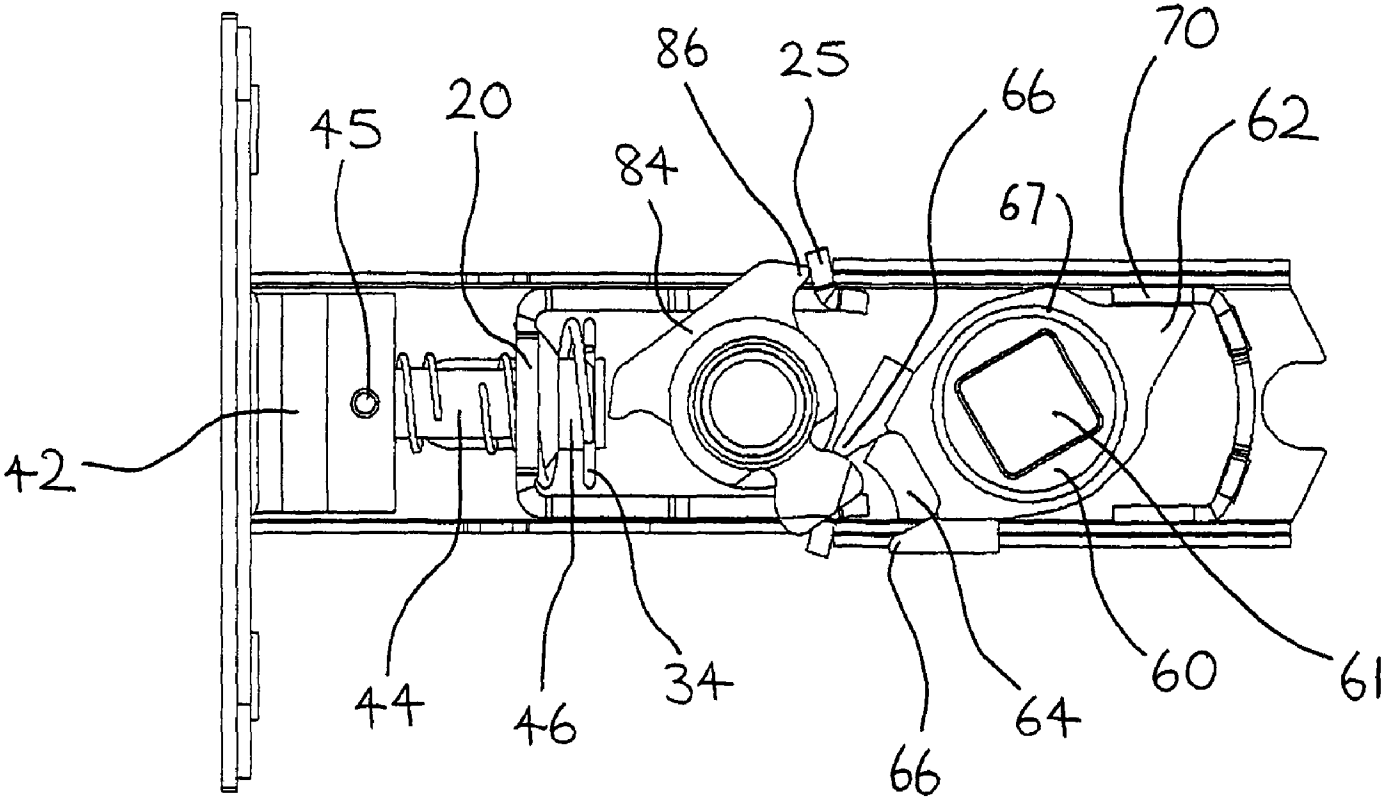
Figure 5C:
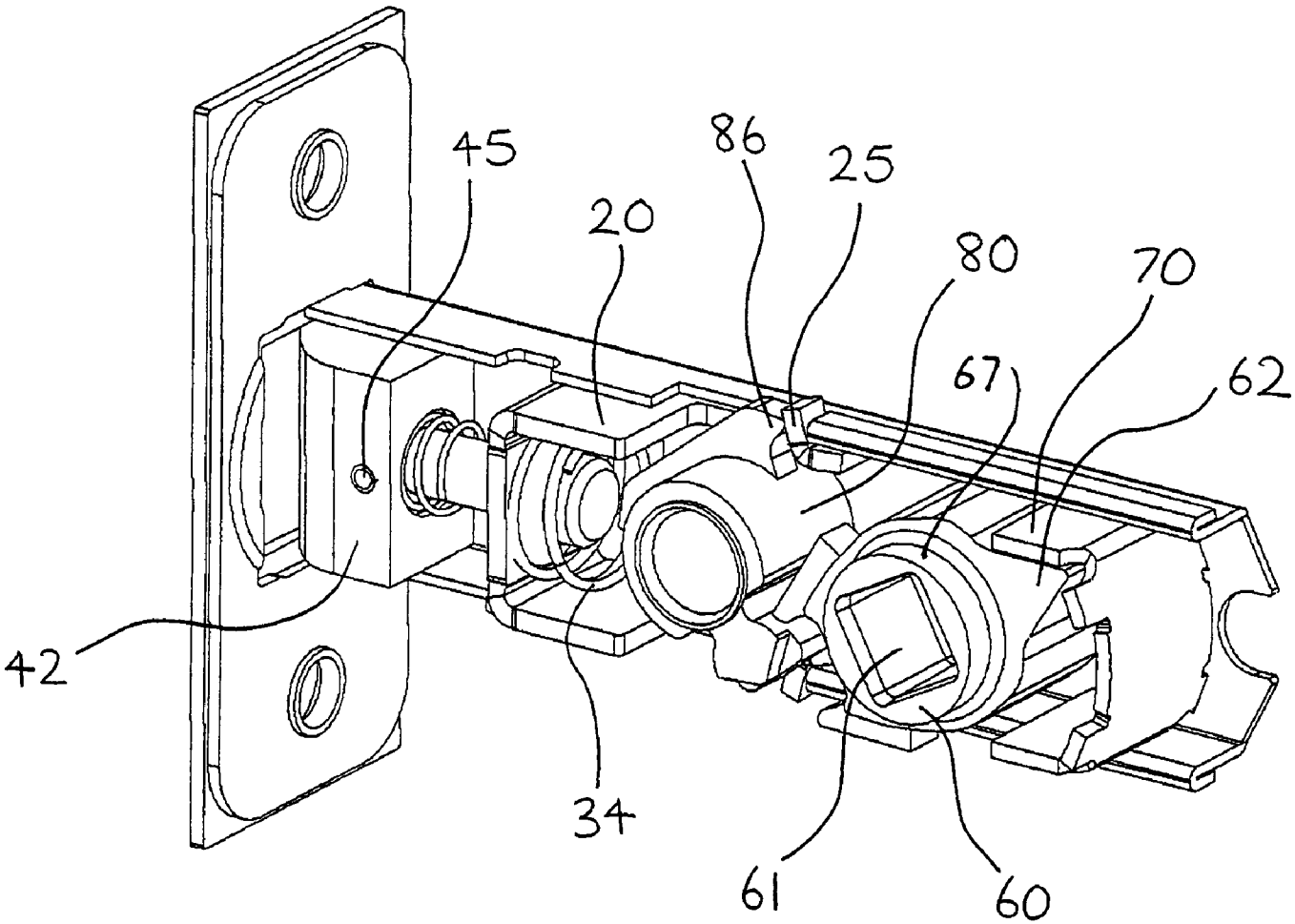
Figure 6A:
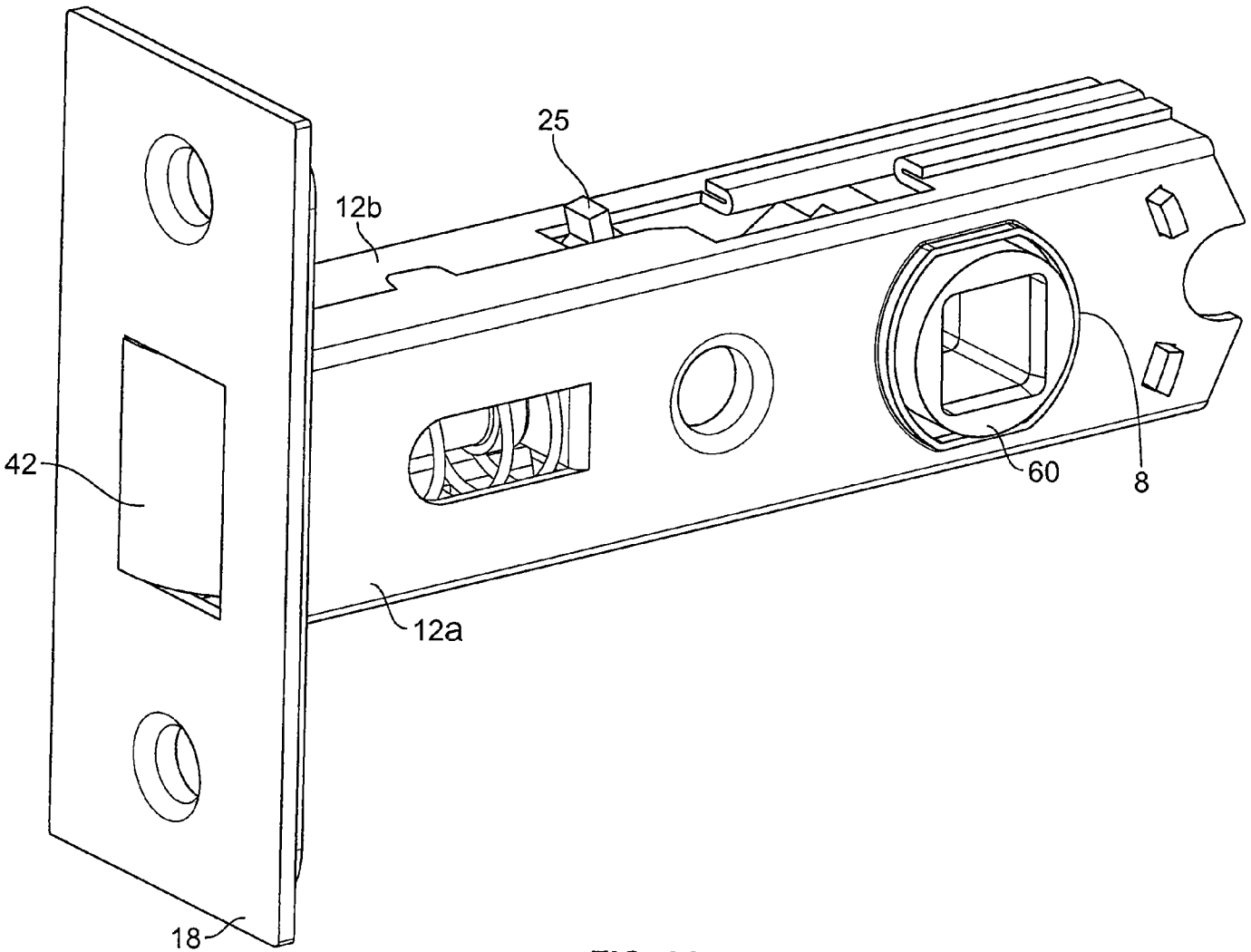
FIGS. 6A, 6B and 6C respectively show assembled perspective, partly assembled lateral and assembled perspective views of the latch of FIG. 4 in an inactive unlatching configuration with the cams in a return position and the lock bolt retracted.
Figure 6B:
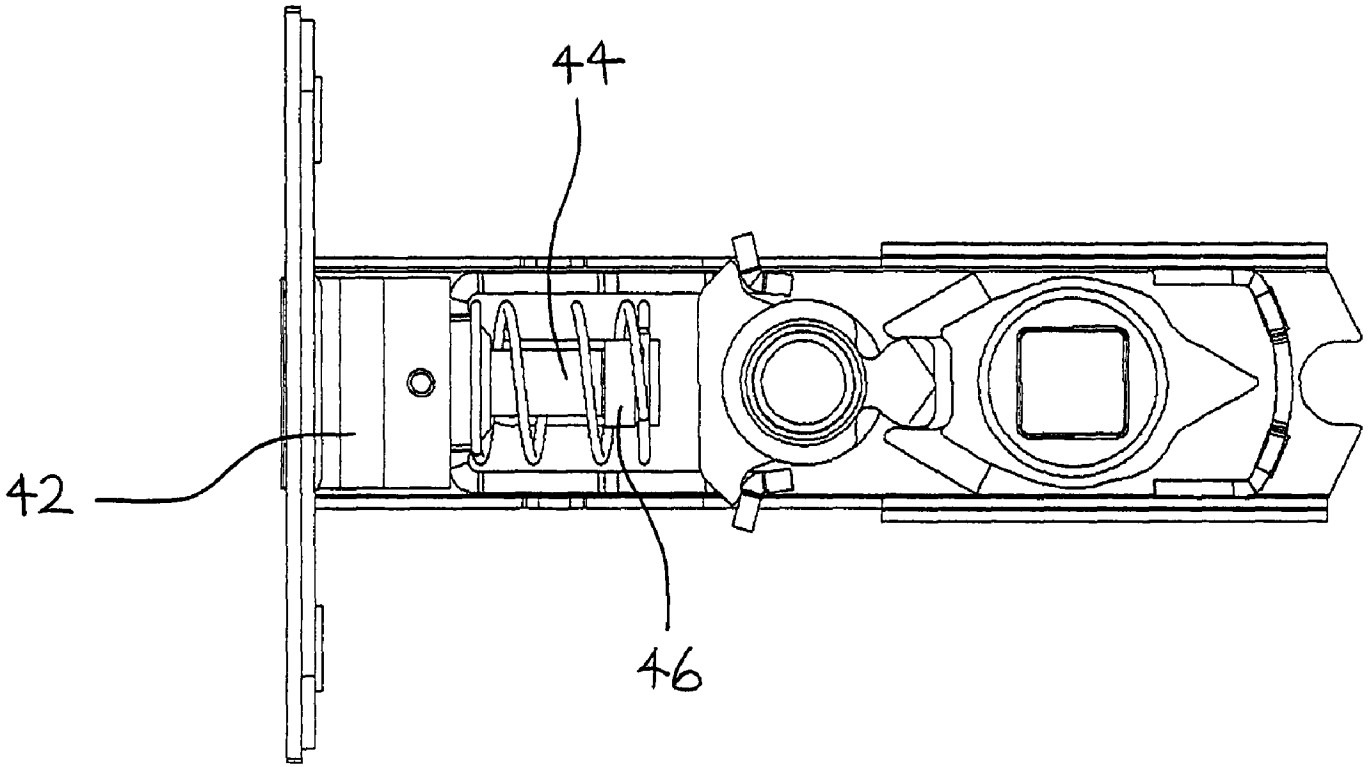
Figure 6C:
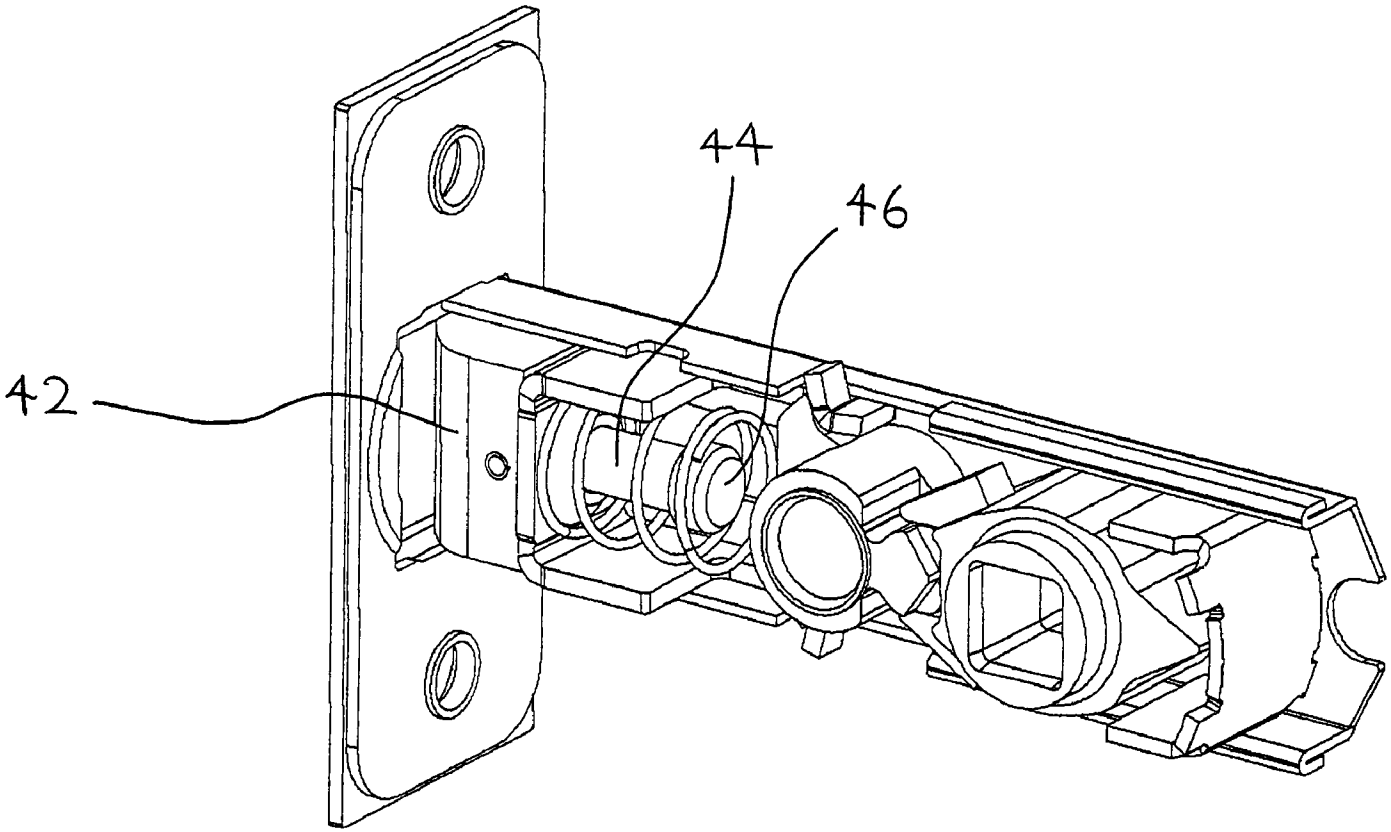

FIGS. 3A-3C show the latch 10 in an inactive unlatching configuration in which the cams 60 and 80 are in the return position and the lock bolt 42 is retracted in an engaged position. This configuration corresponds to the closing of the door without turning of the door furniture. During the closing of the door, the lock bolt 42 engages a strike plate (not shown) which is attached to a door jamb (not shown). The strike plate urges the lock bolt 42 to retract into the engaged position by forcing the lock bolt stem 44 to retract into the carriage 20, which compresses the second spring 50 until the lock bolt 42 is retracted into the casing 12. When the lock bolt 42 is aligned with a recess (not shown) formed in the strike plate (not shown), the second spring 50 urges the lock bolt 42 to extend to the rest position to retain the door closed with the latch 10 in the latching configuration (see FIGS. 1A-1C).

Also, as the springs 30, 50 and other components are disposed between the master cam 60 and the bolt 42, then the casing 12 has a relatively smaller rear overhang to the recess 6 which results in a more compact latch 10.

FIGS. 4A to 6C show a second preferred embodiment of a latch 110 according to the present invention, with like features to those of the first embodiment indicated with like reference numerals. The latch 110 differs from the latch 10 in that the main lobe 64 of the master cam 60 is more deeply recessed between the cam arms 66 and the tail lobe 82 of the slave cam 80 has a pair of angled external faces 180 on its sides. The operation of the latch 110 corresponds to that of the latch 10.

Although preferred forms of the present invention have been described, it will be apparent to persons skilled in the art that modifications can be made to the preferred embodiments described above or that the invention can be embodied in other forms.

I claim:

1. A latch including:

a casing adapted to be fixedly mounted in a door;

a carriage mounted in the casing and adapted for slidable movement relative to the casing between an actuated position and a return position;

a first spring biasing the carriage to the return position;

an actuator for driving the carriage to the actuated position;

a lock bolt mounted to the carriage and biased to protrude from the casing when the carriage is in the return position;

a lock bolt assembly in which the lock bolt is adapted for slidable movement relative to the carriage between a rest position and an engaged position and in which a second spring is provided to bias the lock bolt towards the rest position; and a master cam and a slave cam each pivotally mounted to the casing such that the master cam directly acts upon the slave cam with a non-meshing, rolling action, whereby the master cam can pivot in both a clockwise and counterclockwise direction, and wherein pivoting actuation of the master cam in both of the clockwise and counterclockwise directions drives pivoting actuation of the slave cam which in turn actuates sliding movement of the carriage from the return position to the actuated position, both the master and slave cams mounted to the casing for pivoting about axes that are substantially perpendicular to the sliding movement direction of the carriage, the master cam including opposed cylindrical bosses which are slidably received in respective opposed obround recesses in the casing to allow for selective float movement of the master cam axis in the carriage sliding movement direction; wherein the carriage at least partially extends over the slave cam but not the master cam;

wherein when the carriage is in the actuated position, the bolt is sufficiently retracted to enable the door to be opened and pivoting actuation of the master cam through at most 35° is sufficient to move the carriage to the actuated position.

2. The latch as claimed in claim 1, wherein the master cam and the slave cam are shaped so as not to protrude from the casing during operation.

3. The latch as claimed in claim 1, wherein the shape of the cams is such that, in the actuated position, extremities of the master cam and the slave cam are flush with the casing exterior.

4. The latch as claimed in claim 1, wherein the stroke of the carriage is defined as the distance moved by the carriage between the actuated and return positions and is between 8.5 and 9.5 mm.

5. The latch as claimed in claim 4, wherein the stroke of the carriage is 9 mm.

6. The latch as claimed in claim 1, wherein the casing is elongate and has a first end and a second end.

7. The latch as claimed in claim 6, wherein a face plate is mounted at, and the lock bolt protrudes from, the first end.

8. The latch as claimed in claim 6, wherein the master cam is mounted in the casing adjacent the second end.

9. The latch as claimed in claim 8, wherein the carriage moves in a longitudinal direction and the slave cam is mounted longitudinally adjacent the master cam.

10. The latch as claimed in claim 5, wherein a backset of the latch is defined as the distance from the face plate to the axis of pivoting of the master cam and is one of 60, 70, 95 or 127 mm.

11. The latch as claimed in claim 1, wherein the casing is provided with two said transverse apertures.

12. The latch as claimed in claim 6, wherein the carriage is a substantially U-shaped member having two spaced apart side walls extending from an open end and joined by a closed end.

13. The latch as claimed in claim 12, wherein the open end is arranged about the slave cam with the closed end extending towards the casing first end.

14. The latch as claimed in claim 12, wherein the U-shaped member walls include elongated apertures having engagement surfaces for engagement by the slave cam for sliding the carriage upon operation of the slave cam.

15. The latch as claimed in claim 12, wherein a stop is disposed between the walls of the U-shaped member and fixed relative to the casing, the first spring being disposed between the U-shaped member closed end and the stop in order to bias the carriage to slide in a first direction.

16. The latch as claimed in claim 1, wherein pivoting of the master cam is limited to a maximum of 32°.

17. The latch as claimed in claim 1, wherein the master cam further includes a pair of cam arms for engaging the slave cam.

18. The latch as claimed in claim 17, wherein the cam arms extend tangentially of the cam body and laterally of the main lobe.

19. The latch as claimed in claim 1, wherein the actuator is a knob or lever mountable to the door for pivotal actuation of the master cam and having corresponding actuated and return positions.

20. The latch as claimed in claim 1, wherein the latch casing further includes a spacer arranged at a second end and adapted for contacting a master cam tail lobe on the master cam to limit the pivotal rotation of the master cam.

21. The latch as claimed in claim 1, wherein the slave cam comprises a cylindrical cam body having a main lobe on one side of the cam body and a diametrically opposed tail lobe on an opposite side of the cam body, the slave cam tail lobe being adapted to be engaged by cam arms of the master cam to drive the pivotal actuation of the slave cam.

22. The latch as claimed in claim 21, wherein the main lobe of the slave cam extends radially and tangentially of the slave cam body and has tangentially opposed shoulders adapted to be received by apertures of the carriage side walls, to engage engagement surfaces of the carriage, and to thereby drive the sliding movement of the carriage when the slave cam is pivotally actuated.

23. The latch as claimed in claim 22, wherein the action of the cams on each other and on the carriage is such that the angles of contact between the cams, and between the lobe shoulders and carriage, follow a rolling action.

24. The latch as claimed in claim 1, wherein the first spring has a greater spring constant than the second spring.

25. The latch as claimed in claim 24, wherein the lock bolt assembly further includes a stem.

26. The latch as claimed in claim 25, wherein the stem extends from the lock bolt and is slidably received in an aperture provided in a closed end of the carriage.

27. The latch as claimed in claim 26, wherein the second spring is disposed between the carriage and the lock bolt, in order to bias the lock bolt towards the rest position.

28. The latch as claimed in claim 1, wherein the master cam is larger in diameter than the slave cam.

29. The latch as claimed in claim 1, wherein the latch is operable by pivoting actuation of the master cam in either a clockwise or a counter-clockwise direction.

30. A latch including:

a casing adapted to be fixedly mounted in a door;

a carriage mounted in the casing and adapted for slidable movement relative to the casing between an actuated position and a return position;

a first spring biasing the carriage to the return position;

an actuator for driving the carriage to the actuated position;

a lock bolt mounted to the carriage and biased to protrude from the casing when the carriage is in the return position;

a lock bolt assembly in which the lock bolt is adapted for slidable movement relative to the carriage between a rest position and an engaged position and in which a second spring is provided to bias the lock bolt towards the rest position; and a master cam and a slave cam each pivotally mounted to the casing such that the master cam directly acts upon the slave cam with a non-meshing, rolling action whereby the master cam can pivot in both a clockwise and counterclockwise direction, and wherein pivoting actuation of the master cam in both of the clockwise and counterclockwise directions drives pivoting actuation of the slave cam which in turn actuates sliding movement of the carriage from the return position to the actuated position, both the master and slave cams mounted to the casing for pivoting about axes that are substantially perpendicular to the sliding movement direction of the carriage, the master cam including opposed cylindrical bosses which are slidably received in respective opposed obround recesses in the casing to allow the master cam axis to be selectively moved in the carriage sliding movement direction; wherein the carriage at least partially extends over the slave cam but not the master cam;

wherein, when the carriage is in the actuated position, the bolt is fully retracted to enable the door to be opened and pivoting actuation of the master cam through at most 35 degrees is sufficient to move the carriage to the actuated position.

31. A latch including:

a casing adapted to be fixedly mounted in a door, the casing including at least one transverse aperture through which door furniture fastening screws can pass;

a carriage mounted in the casing and adapted for slidable movement relative to the casing between an actuated position and a return position;

a first spring biasing the carriage to the return position; an actuator for driving the carriage to the actuated position;

a lock bolt mounted to the carriage and biased to protrude from the casing when the carriage is in the return position;

a lock bolt assembly in which the lock bolt is adapted for slidable movement relative to the carriage between a rest position and an engaged position and in which a second spring is provided to bias the lock bolt towards the rest position; and a master cam and a slave cam each pivotally mounted to the casing such that the master cam directly acts upon the slave cam with a non-meshing, rolling action whereby the master cam can pivot in both a clockwise and counterclockwise direction, and wherein pivoting actuation of the master cam in both of the clockwise and counterclockwise directions drives pivoting actuation of the slave cam which in turn actuates sliding movement of the carriage from the return position to the actuated position;

the master cam including opposed cylindrical bosses which are slideably received in respective opposed obround recesses in the casing to allow for selective float movement of the master cam axis in the carriage sliding movement direction; wherein the carriage at least partially extends over the slave cam but not the master cam;

wherein when the carriage is in the actuated position, the bolt is sufficiently retracted to enable the door to be opened and pivoting actuation of the master cam through at most 35° is sufficient to move the carriage to the actuated position.

32. A latch including:

a casing adapted to be fixedly mounted in a door;

a carriage mounted in the casing and adapted for slidable movement relative to the casing between an actuated position and a return position;

a first spring biasing the carriage to the return position; an actuator for driving the carriage to the actuated position;

a lock bolt mounted to the carriage and biased to protrude from the casing when the carriage is in the return position;

a lock bolt assembly in which the lock bolt is adapted for slidable movement relative to the carriage between a rest position and an engaged position and in which a second spring is provided to bias the lock bolt towards the rest position; and a master cam and a slave cam each pivotally mounted to the casing such that the master cam directly acts upon the slave cam with a non-meshing, rolling action whereby the master cam can pivot in both a clockwise and counterclockwise direction, and wherein pivoting actuation of the master cam in both of the clockwise and counterclockwise directions drives pivoting actuation of the slave cam which in turn actuates sliding movement of the carriage from the return position to the actuated position, the master cam including a cylindrical cam body having a main lobe and a diametrically opposed tail lobe, each extending radially of the cam body, the main and tail lobes being adapted to contact the casing of the latch and to thereby limit the extent of pivoting of the master cam; the master cam including opposed cylindrical bosses which are slideably received in respective opposed obround recesses in the casing to allow for selective float movement of the master cam axis in the carriage sliding movement direction; wherein the carriage at least partially extends over the slave cam but not the master cam;

wherein when the carriage is in the actuated position, the bolt is sufficiently retracted to enable the door to be opened and pivoting actuation of the master cam through at most 35° is sufficient to move the carriage to the actuated position.

33. A latch including:

a casing adapted to be fixedly mounted in a door;

a carriage mounted in the casing and adapted for slidable movement relative to the casing between an actuated position and a return position;

a first spring biasing the carriage to the return position; an actuator for driving the carriage to the actuated position;

a lock bolt mounted to the carriage and biased to protrude from the casing when the carriage is in the return position;

a lock bolt assembly in which the lock bolt is adapted for slidable movement relative to the carriage between a rest position and an engaged position and in which a second spring is provided to bias the lock bolt towards the rest position;

and a master cam and a slave cam each pivotally mounted to the casing such that the master cam directly acts upon the slave cam with a non-meshing, rolling action whereby the master cam can pivot in both a clockwise and counterclockwise direction, and wherein pivoting actuation of the master cam in both of the clockwise and counterclockwise directions drives pivoting actuation of the slave cam which in turn actuates sliding movement of the carriage from the return position to the actuated position, wherein the master cam is as large in diameter as the latch casing will accommodate;

the master cam including opposed cylindrical bosses which are slideably received in respective opposed obround recesses in the casing to allow for selective float movement of the master cam axis in the carriage sliding movement direction; wherein the carriage at least partially extends over the slave cam but not the master cam;

wherein when the carriage is in the actuated position, the bolt is sufficiently retracted to enable the door to be opened and pivoting actuation of the master cam through at most 35° is sufficient to move the carriage to the actuated position.

* * * * *